US012653283B2

(12) United States Patent
Benno Nerger et al.

(10) Patent No.: US 12,653,283 B2
(45) Date of Patent: Jun. 16, 2026

(54) SPREADING MECHANISM FOR AN EXPANDABLE APPARATUS AS WELL AS EXPANDABLE APPARATUS

(71) Applicant: NerTes GmbH Mobile Ständertechnik, Handewitt (DE)

(72) Inventors: Jürgen Heinrich Benno Nerger, Handewitt (DE); Heiko Teske, Glücksburg (DE)

(73) Assignee: NerTes GmbH Mobile Ständertechnik, Handewitt (DE)

( * ) Notice: Subject to any disclaimer, the term of this patent is extended or adjusted under 35 U.S.C. 154(b) by 56 days.

(21) Appl. No.: 18/673,747

(22) Filed: May 24, 2024

(65) Prior Publication Data

US 2025/0248495 A1 Aug. 7, 2025

(30) Foreign Application Priority Data

Feb. 1, 2024 (EP) ..... 24155285

(51) Int. Cl.
*A45B 25/14* (2006.01)
*A45B 23/00* (2006.01)
(Continued)

(52) U.S. Cl.
CPC ..... *A45B 25/14* (2013.01); *A45B 23/00* (2013.01); *A45B 25/143* (2013.01); *A45B 25/16* (2013.01);
(Continued)

(58) Field of Classification Search
CPC ..... A45B 25/14; A45B 23/00; A45B 25/143; A45B 25/16; A45B 2023/0012; A45B 2200/1009; A45B 2025/146; D06F 57/04
(Continued)

(56) References Cited

U.S. PATENT DOCUMENTS 4,735,326 A * 4/1988 Steiner ..... D06F 57/04 211/119.01
4,802,596 A * 2/1989 Steiner ..... D06F 53/045 24/127
(Continued)

FOREIGN PATENT DOCUMENTS

CN 106889721 A 6/2017
CN 113529371 A 10/2021
(Continued)

OTHER PUBLICATIONS

European search report dated Jul. 8, 2024 for EP 24 155 285.0.
Communication pursuant to Article 94(3) EPC dated Jul. 19, 2024 for EP 24 155 285.0.

*Primary Examiner* — Robert Canfield
(74) *Attorney, Agent, or Firm* — Rankin, Hill & Clark LLP

(57) ABSTRACT

A spreading mechanism for an expandable apparatus and an expandable apparatus including a stanchion and an expandable supporting structure having several pairs of support arms extending apart in a star-shaped manner and support struts hinged to the support arms. The support arms are hinged to a first central fixture and the support struts are hinged to a second central fixture. The spreading mechanism expands or closes the supporting structure by reducing or increasing the distance between the first central fixture and the second central fixture. The spreading mechanism includes an actuating mechanism and a pulley block with a pulley block rope, a fixedly affixed first pulley block roll holder and a movable second pulley block roll holder, each with one or more pulley block rolls through which the pulley block rope is guided. The actuating mechanism is connected to the movable second pulley block roll holder of the pulley block, and a fast end of the pulley block rope acts in a
(Continued)

shifting manner on the first and/or the second central fixture in order to change their distance to each other.

16 Claims, 3 Drawing Sheets

(51) Int. Cl.
*A45B 25/16* (2006.01)
*D06F 57/04* (2006.01)

(52) U.S. Cl.
CPC ..... *D06F 57/04* (2013.01); *A45B 2023/0012* (2013.01); *A45B 2200/1009* (2013.01)

(58) Field of Classification Search
USPC ..... 135/20.3, 22, 24; 211/197
See application file for complete search history.

(56) References Cited

U.S. PATENT DOCUMENTS

| | | | | | |
|---|---|---|---|---|---|
| 4,807,655 | A * | 2/1989 | Robertson | A45B 23/00 | 135/22 |
| 4,928,718 | A * | 5/1990 | Apple | A45B 25/16 | 135/22 |
| 6,016,822 | A * | 1/2000 | Lin | A45B 25/16 | 135/37 |
| 6,173,721 | B1 * | 1/2001 | Mery | A45B 25/14 | 135/27 |
| 6,415,805 | B1 * | 7/2002 | Kuo | A45B 25/006 | 135/25.1 |
| 7,051,744 | B2 * | 5/2006 | Hung | A45B 25/165 | 135/22 |
| 7,174,905 | B2 * | 2/2007 | Hung | A45B 17/00 | 135/20.1 |
| 7,520,289 | B1 * | 4/2009 | Barber | A45B 23/00 | 135/21 |
| 8,087,420 | B1 * | 1/2012 | Lukacsy | A45B 25/16 | 135/22 |
| 8,544,485 | B2 * | 10/2013 | Ko | A45B 25/143 | 135/25.4 |
| 10,653,218 | B1 * | 5/2020 | Volin | A45B 25/02 | |
| 10,765,186 | B2 * | 9/2020 | Letendre | A45B 25/10 | |
| 12,383,036 | B2 * | 8/2025 | Mao | A45B 23/00 | |
| 2005/0229958 | A1 * | 10/2005 | Hung | A45B 17/00 | 135/20.3 |
| 2009/0133729 | A1 | 5/2009 | Chong | | |
| 2012/0266927 | A1 * | 10/2012 | Lukacsy | A45B 25/16 | 29/25 |
| 2021/0401135 | A1 * | 12/2021 | Wang | A45B 23/00 | |

FOREIGN PATENT DOCUMENTS

| | | | | | |
|---|---|---|---|---|---|
| DE | 8517737 | U1 | 12/1985 | | |
| DE | 29801962 | U1 | 9/1999 | | |
| DE | 29903467 | U1 | 11/1999 | | |
| DE | 102005020027 | A1 * | 11/2006 | D06F 57/04 | |
| DE | 102008052049 | A1 | 4/2010 | | |
| EP | 3070198 | B1 | 6/2017 | | |
| EP | 3896212 | A1 | 10/2021 | | |
| WO | WO-2006117092 | A2 * | 11/2006 | D06F 57/04 | |
| WO | WO-2009026902 | A1 * | 3/2009 | D06F 57/04 | |

* cited by examiner

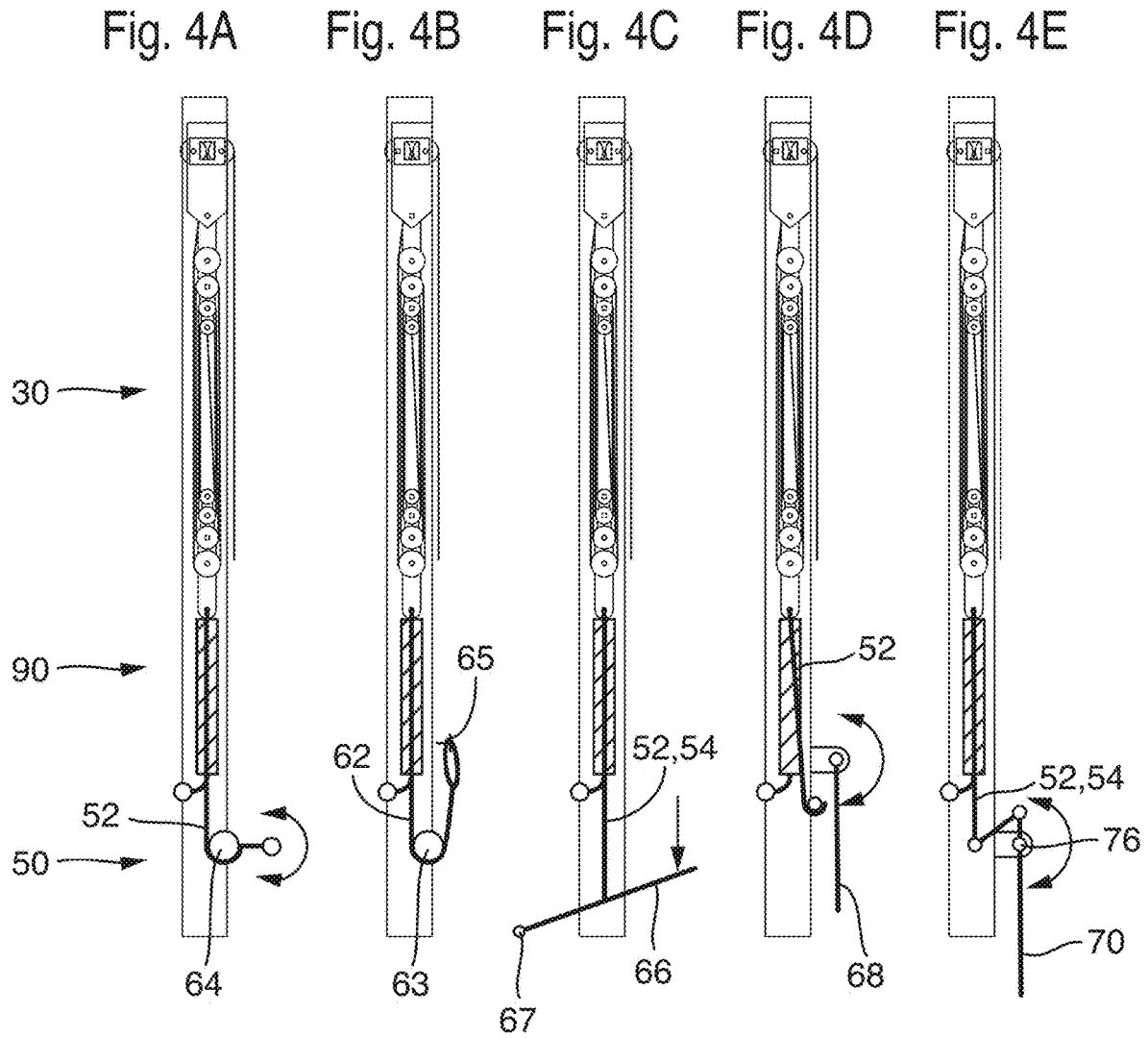
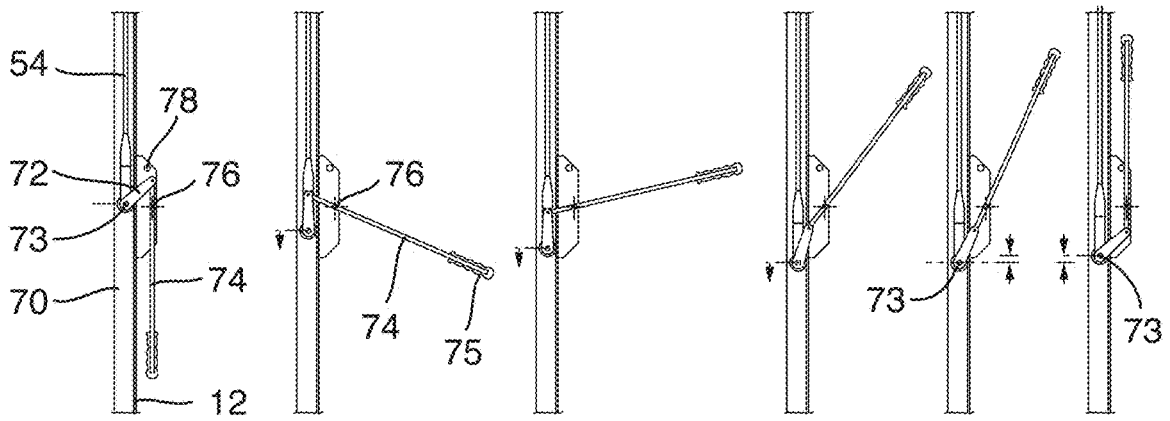
Fig. 5

SPREADING MECHANISM FOR AN EXPANDABLE APPARATUS AS WELL AS EXPANDABLE APPARATUS

PRIORITY CLAIM

This application claims priority to EP 24 155 285.0, filed Feb. 1, 2024.

BACKGROUND OF INVENTION

Field of Invention

The invention relates to a spreading mechanism for an expandable apparatus, such as a standing umbrella or a rotary clothes dryer, as well as an expandable apparatus.

Brief Description of Related Art

Rotary clothes dryers and standing umbrellas, both in the form of center-mast umbrellas and side-arm umbrellas, have very similar expandable support apparatuses. Particularly similar are central mast umbrella and rotary clothes dryers, each of which has a plurality of support arms, which are hinged centrally to a holding apparatus on the central mast or stanchion, as well as an equal number of support struts, which are hinged to the support arms and are hinged towards the center to a further holding apparatus on the central stanchion. In the case of the standing umbrellas, the support arms carry an umbrella cover made of fabric or another flexible planar material, and clothes lines in the case of the rotary clothes dryers.

The configuration of the support arms and support struts differs between the standing umbrellas and the rotary clothes dryers in that, for the standing umbrellas, the support arms are mostly attached at the top of the stanchion to a holding apparatus, also referred to as "crown", which is fixed to the top end of the stanchion, and the support struts are attached to the second holding apparatus underneath, which is vertically displaceable on the stanchion. This is also referred to as raceway or sliding sleeve. In contrast, for rotary clothes dryers, the support struts are usually attached to the upper fixed holding apparatus and the support arms to the lower vertically displaceable holding apparatus.

In both cases, the expandable support apparatus is expanded by pushing the lower holding apparatus upward, thereby reducing the distance between the two holding apparatuses and displacing the support arms to an expanded position. Thereby, for the parasols, the support arms are inclined downward, for the rotary clothes dryers upward.

For side arm umbrellas the principle is very similar. However, the holding apparatuses are not affixed directly to the stanchion. Instead, a side arm branches off from the stanchion, or a bent stanchion is used, from the tip of which a lateral mechanism emanates, with which the two holding apparatuses can be changed in their distance to each other.

Finally, there are also combinations of standing umbrellas and rotary clothes dryers on the market, in which the umbrella is affixed above the clothes lines and both parts are expanded with a mechanism, as known, for example, from DE 10 2008 052 049 A1 or from EP 3 070 198 B1.

For rotary clothes dryers and standing umbrellas various spreading mechanisms are in use and known. While in case of hand-held umbrellas and small parasols, the axially shiftable sliding sleeve is manually shifted up to a locking apparatus, for rotary clothes dryers or larger standing umbrellas, for example, hand-pull ropes or crank-operated ropes are used.

There are also electric drives or pulleys. These are used, for example, in rotary clothes dryers, in which the end of the pulley block rope is led out of the stanchion, within which the pulley is disposed, and a large length of the pulley block rope is pulled out, in order to push up, under a corresponding multiplication of the force to be applied, the lower holding apparatus connected to a movable pulley block roll holder of the pulley block by a smaller amount on the stanchion and so to expand the supporting frame of the rotary clothes dryer. This is often combined with a return device for the long end of the pulley block rope, which is pulled back into the stanchion once the long pulley block rope is released.

Particularly at the end of the expanding process, a strong lateral pull is exerted on the stanchion of the rotary clothes dryer, so that a good anchoring in the ground or a very stable stand is necessary, in order that the rotary clothes dryer does not tip over. It is similar with pulley-operated standing umbrellas.

With regard to the known spreading mechanisms and expandable apparatuses, the object of the present invention is to specify a spreading mechanism and an expandable apparatus with which the supporting structure can be expanded with little physical effort.

BRIEF SUMMARY OF THE INVENTION

This object is achieved by a spreading mechanism for an expandable apparatus including a stanchion and an expandable supporting structure having several pairs of support arms extending apart in a star-shaped manner and support struts hinged to the support arms, wherein the support arms are hinged to a first central fixture and the support struts are hinged to a second central fixture, and the spreading mechanism is designed to expand or close the supporting structure by reducing or increasing the distance between the first central fixture and the second central fixture, which is further developed in that the spreading mechanism includes an actuating mechanism and a pulley block with a pulley block rope, a fixedly affixed first pulley block roll holder and a movable second pulley block roll holder, each with one or more pulley block rolls, through which the pulley block rope is guided, wherein the actuating mechanism is connected to the movable second pulley block roll holder of the pulley block and a fast end of the pulley block rope acts in a shifting manner on the first central fixture and/or the second central fixture in order to change their distance to each other.

The invention is based on the fundamental idea of using a pulley block in the opposite direction to the usual way of spreading the supporting structure. The fast end of the pulley block, thus the end of the pulley block rope that moves fast and over a large stretch, is now no longer used to actuate the pulley block, but is connected to the movable second pulley block roll holder, thus the sliding sleeve, while the slow end of the pulley block, thus a movable pulley block roll holder of the pulley block, is subjected to a greater force and a smaller deflection. This is counter-intuitive because the force to be applied to the pulley block is greater than the force required to expand the supporting structure itself. This is compensated for by the actuating mechanism, which is connected to the movable second pulley block roll holder. This actuating mechanism is preferably designed to exert a large force upon small deflection.

The transmission ratio of a pulley block is defined by the number of rope portions of the pulley block rope passing between the two pulley block roll holders and is between 2:1 and 10:1, preferably between 4:1 and 8:1, in embodiments. This includes both even and odd transmission ratios.

In embodiments, the pulley block is disposed in the interior of the stanchion.

Advantageously, the spreading mechanism includes a force assistance device, which is designed to permanently exert a force on the movable second pulley block roll holder of the pulley block, which force is directed in the direction of expanding the supporting structure. This assisting force then no longer has to be applied by means of the actuating mechanism and thus facilitates expanding the supporting structure. The assisting force applied by the assistance device should preferably be measured such that it assists expanding, but does not prevent de-expanding typically assisted by gravity.

In embodiments, the force assistance device is designed as a spring device with a spring or a combination of springs, in particular spiral spring, gas spring and/or gas tension spring, and/or as a weight. These can be accommodated in the stanchion of the apparatus. A spiral spring may be used as a tension spring or as a compression spring, wherein the deflection means in case of a tension spring an elongation and in case of a compression spring a compression of the spring.

While in case of a weight as a force assistance device a position-independent constant force is made available, the force provided by a spring depends on its deflection. The more a spring is deflected, thus elongated or compressed, the greater the restoring force exerted by the spring. Since a spring as a force assistance device, regardless of whether it is used as a tension spring or as a compression spring, relaxes upon assistance of expanding the supporting structure of the apparatus and tensions again upon de-expanding, the assisting force at the end of the expanding process is smaller than at the beginning. At the same time, the spring force in the vicinity of the de-expanded end position, thus there, where it reaches its maximum, must not be so great that collapsing of the supporting structure is impeded.

In this context, when using a spring or combination of springs as a force assistance device, it is provided in embodiments that a spring characteristic of the spring device is linear or degressive or progressive. A degressive characteristic is understood to be a spring characteristic that rises less than linearly with increasing deflection. In other words, a degressive spring characteristic describes a spring that becomes softer with increasing load, harder with decreasing load. This means that the assistance remains comparatively large also with decreasing deflection, thus decreasing load, in order to be able to further assist the expanding process. Preferably, the spring should still have sufficient deflection also in the expanded position of the supporting structure. This ensures a sufficient restoring force also in the more relaxed one of the two end states. In contrast, a progressive spring characteristic describes a spring that respectively becomes harder with increasing load and softer with decreasing load. In further embodiments, the spring device is provided in combination with a weight.

In embodiments, the actuating mechanism is connected in a pull-resistant manner to the movable second pulley block roll holder of the pulley block. In embodiments, this is done in that the actuating mechanism is connected to the movable second pulley block roll holder of the pulley block via a pull rope, a pull chain or via a rigid pull push rod. The latter embodiment with the rigid pull push rod has the additional function that a force can be exerted on the pulley block also through the actuating mechanism for assistance of de-expanding.

In embodiments, the actuating mechanism is designed as a lever, electric winch, as a hand pull rope, as a hand crank, foot pedal or hand lever for a pull rope, or as a hand lever for a rigid pull push rod. Depending on the design of the actuating mechanism, the transmission ratio of the pulley block may be chosen suitably for the force expendable by means of the actuating mechanism. Thus, by means of a hand pull rope a comparatively low expenditure of force is possible, which can be absorbed by a low transmission ratio. A hand crank, a foot pedal or a hand lever, with a correspondingly long lever arm or crank arm, allow for a significantly greater development of force, so that the transmission ratio of the pulley block may also be chosen to be correspondingly larger.

Further, a locking apparatus for the actuating mechanism may be included, or the actuating mechanism may be self-locking. Alternatively, the supporting structure itself may also be designed with a locking apparatus that holds the supporting structure in the expanded state.

In one embodiment where the actuating mechanism is self-locking, the lever of the actuating mechanism comprises a short lever arm and a long lever arm, wherein the short lever arm is connected at one end to the movable second pulley block roll holder of the pulley block and is articulated jointed at its other end with the long lever arm, wherein the long lever arm is pivotally affixed to the stanchion at a first distance from the connection to the short lever arm about a horizontal axis of rotation, wherein the first distance and a second distance of the horizontal axis of rotation from the stanchion are chosen such that in the case of opening of the expandable supporting structure by pivoting the long lever arm from a downward-pointing end position to an upward-pointing end position, the end of the short lever arm connected to the movable second pulley block roll holder of the pulley block passes through a low point and upon reaching the upward-pointing end position of the long lever arm assumes an end position above the low point.

The self-locking is based on the fact that, in the end position, the second pulley block roll holder of the pulley block is not at a low point, but is disposed slightly above. There is need for expenditure of force, in order to move it back down to the low point and beyond, thereby the actuating mechanism having a strong tendency to remain in the end position. This can be assisted by a clamping mechanism, as appropriate, by means of which the long lever arm is clamped and, as appropriate, fixed in its upward-pointing end position.

The object underlying the invention is also achieved by an expandable apparatus having a stanchion and an expandable supporting structure with a plurality of pairs of support arms extending apart in a star-shaped manner and support struts hinged to the support arms, wherein the support arms are hinged to a first central fixture and the support struts are hinged to a second central fixture, as well as a spreading mechanism, which is designed to expand or close the supporting structure by reducing or increasing the distance between the first central fixture and the second central fixture, in which the spreading mechanism is designed as previously described according to the invention.

The expandable apparatus thus embodies the same advantages, properties and features as the spreading mechanism according to the invention.

In embodiments, the expandable apparatus is designed as a standing umbrella, in particular a center-mast umbrella or side-arm umbrella, as a rotary clothes dryer or as a combination of rotary clothes dryer and center-mast umbrella.

Further features of the invention will become apparent from the description of the embodiments according to the invention together with the claims and the attached drawings. Embodiments according to the invention may fulfill individual features or a combination of several features.

In the context of the invention, features being identified with "in particular" or "preferably" are to be understood as optional features.

BRIEF DESCRIPTION OF THE DRAWINGS

The invention will be described below without restricting the general inventive idea on the basis of exemplary embodiments with reference to the drawings, and regarding any details according to the invention which are not explained further in the text reference is expressly made to the drawings. They show in.

In the drawings, the same or similar types of elements and/or parts are provided with the same reference numbers so that a corresponding re-introduction is omitted, respectively.

DETAILED DESCRIPTION OF THE INVENTION

Figure 1A:
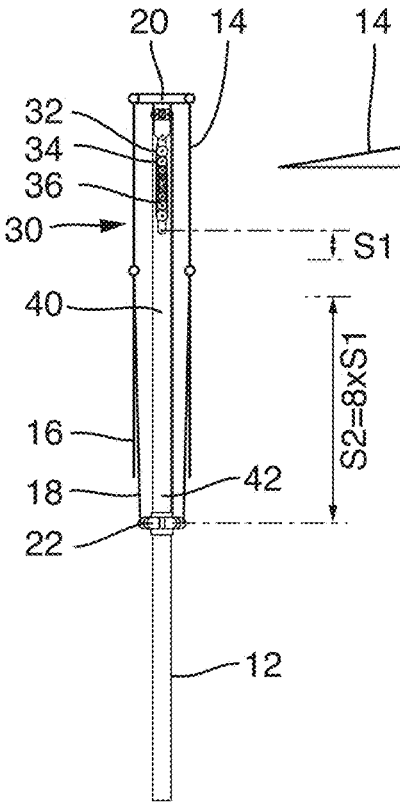
FIG. 1A a schematic representation of a standing umbrella in the closed state, FIG. 1B a schematic representation of a standing umbrella in the opened state.
Figure 1B:
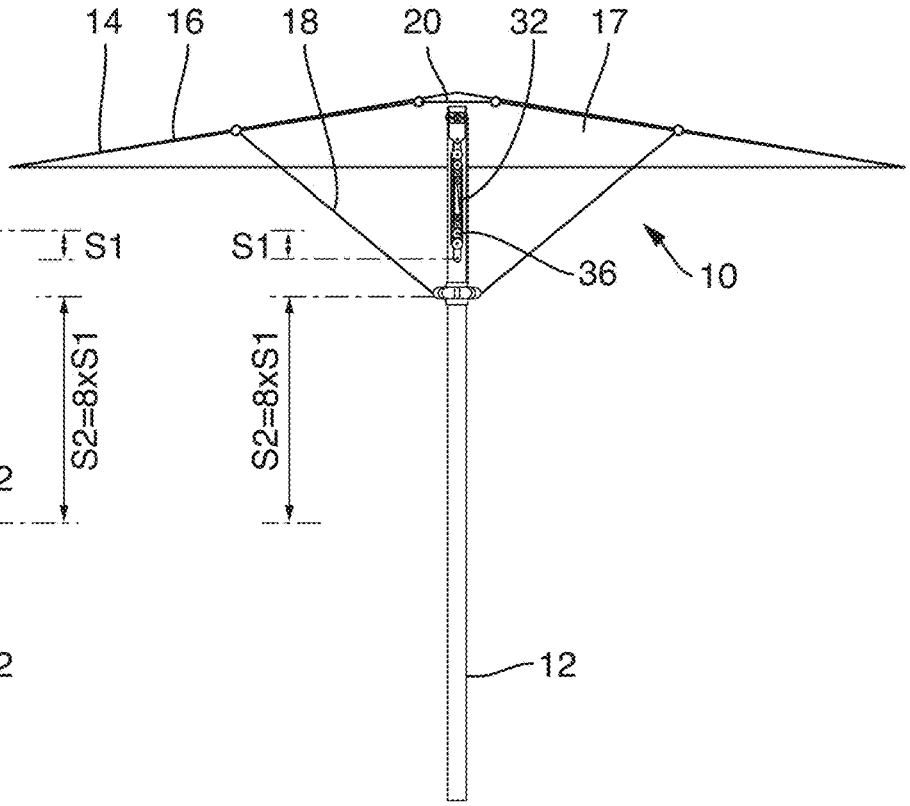

FIG. 1A shows a schematic representation of a standing umbrella as an example of an expandable apparatus 10 in the closed state. FIG. 1B shows a schematic representation of the same standing umbrella as shown in FIG. 1A as an example of an expandable apparatus 10 in the open state. The standing umbrella disposes of a stanchion 12, also referred to as a mast, which (not represented) may be anchored to the ground or set up with a stable pedestal. At its upper end, the standing umbrella carries a supporting structure 14 having a plurality of support arms 16, each of which is articulated jointed with a support strut 18. The support arms 16, on which an umbrella cover 17 rests, converge centrally on a first central fixture 20, also referred to as a crown, where they are hingedly suspended. Approximately in the center of the support arms 16, articulated connections to the support struts 18 are located, which in turn pass from the support arms 16 in the direction of the stanchion 12, where they are hingedly attached to a shiftable second central fixture 22, which is also referred to as a sliding sleeve or the like.

In the closed state shown in FIG. 1A, the support arms 16 hang down substantially vertically from the first central fixture 20, which is fixedly connected to the upper end of the stanchion 12, just as the support struts 18. The distance between the first central fixture 20 and the shiftable second central fixture 22 is at maximum in this state. In the expanded state shown in FIG. 1B, the support arms 16 point apart, but maintain a straight angle typical for standing umbrellas. The support arms 16 are held in the expanded position by the support struts 18. To this end, the second central fixture 22 has been shifted from its lower position to an upper position by a vertical stroke S2.

Additionally, a spreading mechanism 30 with a pulley block 32 according to the present invention in the upper region of the stanchion 12 is further shown in FIGS. 1A and 1B. The pulley block 32 includes a fixedly suspended first pulley block roll holder 34 and thereunder a movable second pulley block roll holder 36, each having a plurality of pulley block rolls 38. A pulley block rope 40, which can be clearly seen in FIG. 2, passes, wound several times, through the plurality of pulley block rolls 38 on the first pulley block roll holder 34 and the second pulley block roll holder 36. The pulley block rope 40 is connected by its fast end 42 to the shiftable second central fixture 22. The pulley block 32 is hinged such that a vertical shift of the movable second pulley block roll holder 36 by a stroke S1 is converted into an opposite stroke S2 of the fast end 42 of the pulley block rope 40. In the exemplary embodiment of FIGS. 1A and 1B, just as in the following exemplary embodiments, the transmission ratio of the strokes S2 to S1 is chosen to be 8:1. Conversely, the transmission ratio also applies to the force to be applied for expanding the supporting structure 14, which is thus increased eightfold.

Figure 2:
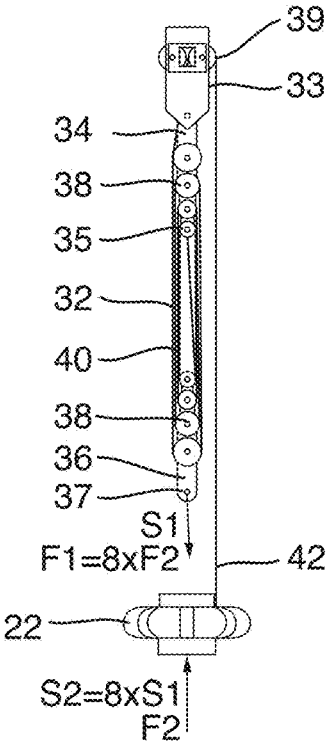
FIG. 2 a schematic representation of an embodiment of a spreading mechanism according to the invention.

FIG. 2 is a schematic representation of an embodiment of a spreading mechanism according to the invention according to FIGS. 1A and 1B in more detail. Therein it is visible, that the pulley block 32 is suspended with its upper first pulley block roll holder 34 from an upper suspension 33, while the lower second pulley block roll holder 36 is freely movable with regard to the first pulley block roll holder 34. Both the first pulley block roll holder 34, and the second pulley block holder 36, each hold four pulley block rolls 38 of different circumferences, around which the pulley block rope 40 is wound in a manner typical of a pulley. The number of portions of the pulley block rope 40 between the first pulley block roll holder 34 and the second pulley block roll holder 36 is eight and determines the transmission ratio 8:1 of the pulley block 32. To this end, the pulley block rope 40 is fastened with its one end to an upper attachment point 35, which coincides with the axis of the lowermost pulley block roll 38 of the first pulley block roll holder 34. Subsequently, the pulley block rope 40 is respectively guided four times downward to a pulley block roll 38 of the second pulley block roll holder 36 and again upward to a pulley block roll 38 of the first pulley block roll holder 34. After the last guidance of the pulley block rope 40 upwards, the pulley block rope 34 is guided into the upper suspension 33 and there through a redirection roll 39 outwards and downwards to the shiftable second central fixture 22.

The lower second pulley block roll holder 36 in addition disposes of a lower attachment point 37 to which a force is applied, which can be applied by an actuating device of the spreading mechanism. As also indicated in FIG. 2, the transmission ratio 8:1 means for the pulley block 32 that a stroke S1 of the second pulley block roll holder 36 is converted into an opposite stroke S2 of the second central fixture 22. In its absolute value, the stroke S2 is eight times the stroke S1. Conversely, the force F2 on the second central fixture 42 is only one eighth of the force F1 exerted on the second pulley block roll holder 36.

Figure 3A:
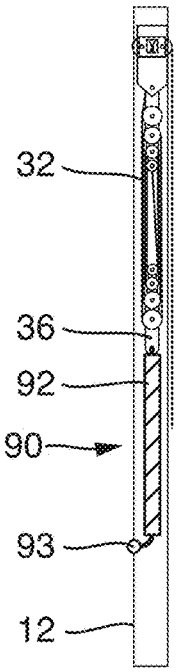
FIG. 3A a schematic representation of a first embodiment of a spreading mechanism according to the invention, FIG. 3B a schematic representation of a second embodiment of a spreading mechanism according to the invention, FIGS. 4A-4E schematic representations of embodiments of spreading mechanisms with different actuating mechanisms, a schematic representation of a sequence of views FIG. 5 showing a mode of operation of an embodiment of a spreading mechanism having a self-locking actuating mechanism, FIG. 6 a schematic representation of a rotary clothes dryer in the opened state, and FIG. 7 a schematic representation of a combination rotary clothes dryer and center mast umbrella.
Figure 3B:
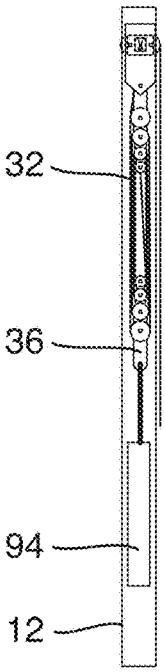

FIGS. 3A and 3B show schematic representations of two embodiments of spreading mechanisms according to the invention, both of which have different force assistance devices 90, each of which is connected, for example suspended, at the lower attachment point 37 to the movable second pulley block roll holder 36 of the pulley block 32. In FIG. 3A, it concerns a spiral spring 92, which is connected at the upper end to the second pulley block roll holder 36 and is fastened at its lower end to a spiral spring attachment 93 on the stanchion 12. In this configuration, the spiral spring 92 is a tension spring.

In FIG. 3A an embodiment is shown, in which the force assistance device 90 is a weight 94 that is suspended from the lower attachment point 37 on the second pulley block roll holder 36. The weight 94 pulls the second pulley block roll holder 36 downward with a constant weight force. With the transmission ratio of 8:1 unchanged with regard to the previous exemplary embodiments, one eighth of the weight force exerted by the weight 94 is applied to the second central holder 22 and is available for assistance of the opening of the supporting structure 14. Also the foot pedal 66 may be provided with a locking apparatus 80.

In FIG. 4D, the actuating mechanism 50 comprises a hand lever 68, on which the pull rope 52 is attached approximately over one third of its extension from a hinge on the stanchion 12 to the open end of the hand lever 68. The supporting structure 14, not represented in FIG. 4, is expanded, in that the hand lever 68 is brought from its downward-facing position, which is shown in FIG. 4D, to an upper position. By the lever action, the movement of the outer end of the hand lever 68 is transmitted to the second pulley block roll holder 36 with a transmission ratio of about 3:1.

FIGS. 4A-4E show several schematic representations of embodiments of spreading mechanisms with different actuating mechanisms. In all of the embodiments represented there is present a force assistance device 90 in the form of a spiral spring 92 according to the illustration in FIG. 3A.

The embodiments of FIGS. 4A-4E differ in the actuating mechanisms 50. In the first embodiment (FIG. 4A), the actuating mechanism 50 comprises a hand crank 64 around which a pull rope 52 is wound. Depending on the length of the crank arm of the hand crank 64, the spreading mechanism 30 can be operated with reasonably little effort to expand the supporting structure 14. The hand crank 64 may be equipped with a lock and/or may be designed to be self-locking.

The second embodiment (FIG. 4B) includes a hand pull rope 62 redirected around a redirection roll 63 as well as a hook 65, around which a loop of the hand pull rope 62 can be placed. The redirection roll 63 makes it possible to pull the loop of the hand pull rope 62 from the bottom upwards with a favorable lever and thus to exert a force on the second pulley block roll holder 36 at a more favorable angle of attack. If the redirection roll 63 is disposed close to the ground, even in the case of pulling sideward, only a small tilting moment is exerted on the apparatus due to the short lever arm to the ground. Because no force transmission occurs, this type of actuating mechanism 50 is particularly suitable for smaller transmission ratios of the pulley block 32. For locking, a further hook 65 for the loop of the hand pull rope 62 may be provided, for example, further up on the stanchion 12.

The embodiment shown in FIG. 4C comprises a foot pedal 66 that is hingedly fixed at a pivot point 67. Approximately in the middle of the longitudinal extension of the foot pedal 66, a pull rope 52 or a rigid pull push rod 54 is connected to the foot pedal 66, which pulls the second pulley block roll holder 36 downward upon pressing down the foot pedal 66. The lever ratios on the foot pedal 66 result in a transmission ratio of 2:1, which in this case means that the stroke path of the open end of the foot pedal 66 is halved during the transmission to the second pulley block roll holder 36 and the force applied is doubled.

The embodiment shown in FIG. 4E is also based on the use of a hand lever 70, which, however, is provided with a self-locking mechanism. This one is represented schematically in FIG. 5 in a sequence of views that show its function from a closed position (left) to an opened and locked position (right).

In this exemplary embodiment, the hand lever 70 includes a long lever arm 74 with a handle 75 and a short lever arm 72, which is articulated jointed with the long lever arm 74 and represents a connection between the long lever arm 74 and a rigid pull push rod 54 in the interior of the stanchion 12, which forms the lever arm 70 with the lower attachment point 37 of the second pulley block roll holder 36, as shown, for example, in FIG. 2. A hinge 73 forms the connection between the short lever arm 72 and the pull push rod 54. The long lever arm 74 is pivotable with regard to the stanchion 12 about a horizontal hinge axis 76 that is suspended from an attachment body 78 affixed laterally outside to the stanchion 12.

On the left in FIG. 5, the initial situation for expanding the supporting structure 14, not represented in FIG. 5, is shown. The long lever arm 74 faces horizontally downward. Slightly above the horizontal axis of rotation 76 of the long lever arm 74, the short lever arm 72 is articulated, which passes obliquely downward into the stanchion 12 and is connected through the hinge 73 to the pull push rod 54, which is in its uppermost position in this situation. This corresponds to the situation shown in FIG. 1A, where the supporting structure 14 is closed.

For expanding, the long lever arm 74 is pivoted upward, which is depicted in the three subsequent partial images of FIG. 5. Deflected through the horizontal axis of rotation 76, the end of the long lever arm 74 connected to the short lever arm 72 moves downward and takes along the pull push rod 54 downward through the hinge 73, thus pulling the second pulley block roll holder 36 of the pulley block 32 downward and thus expanding the supporting structure 14. It can further be seen that a comparatively large transmission ratio is achieved through the ratios of the lengths of the sections of the long lever arm 74, relative to the horizontal axis of rotation 76, so that, in comparison, the supporting structure 14 thus is expanded with little expenditure of force.

The two right-hand partial illustrations of FIG. 5 show the situation shortly before and upon reaching the expanded end position. In the second to last illustration (second from the right), the long lever arm 74 and the short lever arm 72 form a straight line. In this configuration, the hinge 73 occupies its lowest point, i.e. the supporting structure 14 is expanded to its maximum extent.

Upon further pivoting the long lever arm 74 upward up to the end position parallel to the stanchion 12, the short lever arm 72 again bends from the long lever arm 74, so that the hinge 73 assumes a slightly higher position than at its lowest point. Thereby, the supporting structure 14 is minimally relaxed, wherein in this position the tension weighs on the supporting structure 14, which is provided for the expanded operation of the supporting structure 14. This one is slightly less than the tension at the low point of the hinge 73. This means that for relaxing the supporting structure 14 and for pivoting the long lever arm 74 downward from its upward-facing end position, a force must be applied that is greater than the force that acts on the long lever arm 74 respectively on the supporting structure 14 in the end position. In other words, the force ratios are therefore such that the long lever arm 74 is pulled in the direction of the stanchion 12 between the second-to-last position shown and the end position shown on the right. Force must therefore be applied up to the position where the short lever arm 72 and the long lever arm 74 are aligned. Only after the hinge 73 has overcome its low point during de-expanding, the force ratios assist the further relaxation of the supporting structure 14. This can also be assisted by manually actuating the long lever arm 74 downward, as the rigid pull push rod 54 relays the upward movement of the hinge 73 to the second pulley block roll holder 36 of the pulley block 32.

The attachment body 78 may also comprise a clamping recess for the long lever arm 74 of the hand lever 70, which further acts in an assisting manner for locking the long lever arm 74.

The actuating mechanisms 50 shown in FIGS. 4A-4E and 5 are partially disposed near the ground, meaning that a person operating the actuating mechanism 50 does not stand in the way of the opening supporting structure 14.

Figure 6:
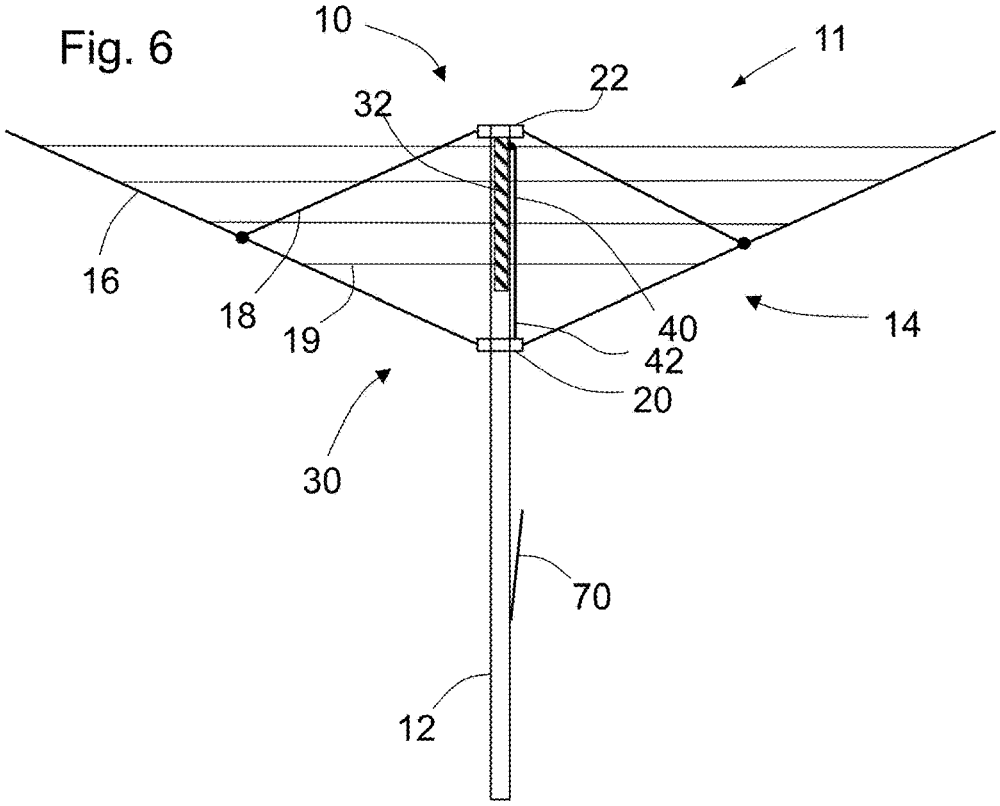

FIG. 6 shows a schematic representation of a rotary clothes dryer 11 in the opened state. Mounted on a central stanchion 12, support arms 16 are hingedly connected to a first central fixture 20 that can slide up and down on the stanchion. Support struts 18 connect the support arms 16 to a second central fixture 22 that is fixed to the top of the stanchion 12. When actuating hand lever 70, the action described in the context of the previous drawings acts on the slideable first central fixture 20 via the fast end 42 of the pulley block rope 40, thereby opening or closing the support arms 16, which have clotheslines 19 running through them and which are spanned and retracted in the way known from prior art rotary clothes dryers.

Figure 7:
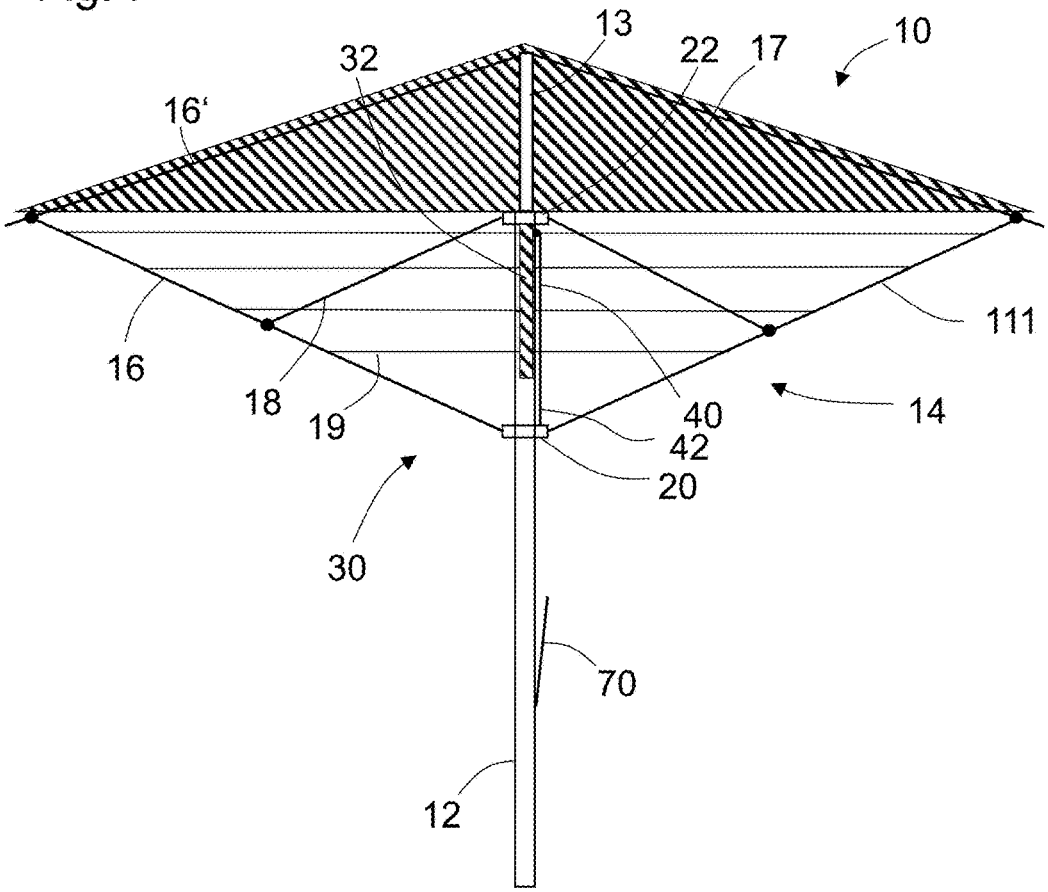

FIG. 7 shows a schematic representation of a combination rotary clothes dryer and center mast umbrella 111. The combination has two sets of support arms, namely an upper set of support arms 16' supporting umbrella cover 17 and a lower set of support arms 16 supporting clotheslines 19. The expansion mechanism is in this case similar to the expansion mechanism of the rotary clothes dryer of FIG. 6. The upper set of support arms 16' of the umbrella part of the combination rotary clothes dryer and umbrella are hingedly connected to the lower set of support arms 16 near or at their respective end points, and to a central telescope pole 13 that can slide into and out of stanchion 12 when the expandable apparatus 10 is expanded. Opening and closing the lower set of support arms 16 thereby directly acts to open or close the upper set of support arms 16' as well.

All of the cited features, also including those to be taken from the drawings alone, as well as individual features, which are disclosed in combination with other features, are considered alone and in combination as essential to the invention. Embodiments according to the invention may be fulfilled by individual features, or a combination of several features.

LISTING OF REFERENCE CHARACTERS APPEARING IN THE DRAWINGS

The following reference characters appear in the accompanying drawing figures:

10 Expandable apparatus
11 Rotary clothes dryer
12 Stanchion
13 Telescope pole
14 Supporting structure
16 Support arm
17 Umbrella cover
18 Support strut
19 Clothesline
20 First central fixture
22 Second central fixture
30 Spreading mechanism
32 Pulley block
33 Upper suspension
34 First pulley block roll holder
35 Upper attachment point
36 Second pulley block roll holder
37 Lower attachment point
38 Pulley block rolls
39 Redirection roll
40 Pulley block rope
42 Fast end of the pulley block rope
50 Actuating mechanism
52 Pull rope
54 Rigid pull push rod
60 Lever
62 Hand pull rope
63 Redirection roll
64 Hand crank
65 Hook
66 Foot pedal
67 Pivot point
68 Hand lever
70 Hand lever
72 Short lever arm
73 Hinge
74 Long lever arm
75 Handle
76 Horizontal axis of rotation
78 Attachment body
80 Locking apparatus
90 Force assistance device
92 Spiral spring
93 Spiral spring attachment
94 Weight
111 Combination rotary clothes dryer and center mast umbrella

What is claimed is:

1. A spreading mechanism for an expandable apparatus including a stanchion and an expandable supporting structure having several pairs of support arms extending apart in a star-shaped manner and support struts hinged to the support arms, wherein the support arms are hinged to a first central fixture and the support struts are hinged to a second central fixture, and the spreading mechanism is configured to expand or close the supporting structure by reducing or increasing the distance between the first central fixture and the second central fixture, wherein the spreading mechanism includes an actuating mechanism and a pulley block with a pulley block rope, a fixedly affixed first pulley block roll holder and a movable second pulley block roll holder each with one or more pulley block rolls, through which the pulley block rope is guided, wherein the actuating mechanism is connected to the movable second pulley block roll holder of the pulley block in such a way that an actuation of the actuating mechanism causes a deflection of the movable second roll holder, and a fast end of the pulley block rope is connected to the first central fixture or to the second central fixture in such a way that it acts in a shifting manner on the central fixture to which it is connected, in order to change their distance to each other, when the actuating mechanism is actuated, wherein the pulley block is disposed in the interior of the stanchion, wherein the actuating mechanism is connected in a pull-resistant manner to the movable second pulley block roll holder of the pulley block, and wherein the actuating mechanism is connected to the movable second pulley block roll holder of the pulley block via a pull rope, a pull chain or via a rigid pull push rod.

2. The spreading mechanism according to claim 1, wherein the pulley block has a transmission ratio being between 2:1 and 10:1.

3. The spreading mechanism according to claim 1, wherein the pulley block has a transmission ratio between 4:1 and 8:1.

4. The spreading mechanism according to claim 1, further comprising a force assistance device, which is configured to permanently exert a force on the movable second pulley block roll holder of the pulley block, which force is directed in the direction of expanding the supporting structure.

5. The spreading mechanism according to claim 4, wherein the force assistance device is a spring device with a spring or a combination of springs.

6. The spreading mechanism according to claim 4, wherein the force assistance device is a spring device with a spring or a combination of springs, and wherein the spring or combination of springs is selected from the group consisting of a spiral spring, a gas spring, and a gas tension spring.

7. The spreader mechanism according to claim 6, wherein the spring device has a linear or degressive or progressive spring characteristic.

8. The spreading mechanism according to claim 4, wherein the force assistance device is a weight.

9. The spreading mechanism according to claim 1, wherein the actuating mechanism is a lever, an electric winch, a hand pull rope, a hand crank, a foot pedal or hand lever for a pull rope, or a hand lever for a rigid pull push rod.

10. The spreading mechanism according to claim 9, wherein the actuating mechanism is a hand lever, wherein the hand lever comprises a short lever arm and a long lever arm, wherein the short lever arm is connected at one end to the movable second pulley block roll holder of the pulley block and is articulated jointed at its other end with the long lever arm, wherein the long lever arm is pivotally affixed to the stanchion at a first distance from the connection to the short lever arm about a horizontal axis of rotation, wherein the first distance and a second distance of the horizontal axis of rotation from the stanchion are selected such that in the case of opening of the expandable supporting structure by pivoting the long lever arm from a downward-pointing end position to an upward-pointing end position, the end of the short lever arm connected to the movable second pulley block roll holder of the pulley block passes through a low point and upon reaching the upward-pointing end position of the long lever arm assumes an end position above the low point.

11. The spreading mechanism according to claim 1, further comprising a locking apparatus for the actuating mechanism or the actuating mechanism is self-locking.

12. An expandable apparatus having a stanchion and an expandable supporting structure with a plurality of pairs of support arms extending apart in a star-shaped manner and support struts hinged to the support arms, wherein the support arms are hinged to a first central fixture and the support struts are hinged to a second central fixture and a spreading mechanism according to claim 1, which is configured to expand or close the supporting structure by reducing or increasing the distance between the first central fixture and the second central fixture.

13. The expandable apparatus according to claim 12, wherein the expandable apparatus is a standing umbrella.

14. The expandable apparatus according to claim 13, wherein the standing umbrella is a center-mast umbrella or side-arm umbrella.

15. The expandable apparatus according to claim 12, wherein the expandable apparatus is a rotary clothes dryer.

16. The expandable apparatus according to claim 12, wherein the expandable apparatus is a combination rotary clothes dryer and center-mast umbrella.

* * * * *